United States Patent [19]

Kumasaka

[11] Patent Number: 4,477,247

[45] Date of Patent: Oct. 16, 1984

[54] LIQUID FUEL BURNING TORCH

[75] Inventor: Haruo Kumasaka, Forest Park, Ill.

[73] Assignee: Beck-Noma Illinois Inc., Forest Park, Ill.

[21] Appl. No.: 388,884

[22] Filed: Jun. 16, 1982

[51] Int. Cl.[3] ..... F23Q 25/00

[52] U.S. Cl. ..... 431/146; 431/320; 431/343

[58] Field of Search ..... 126/45; 431/146, 320, 431/321, 322, 324, 327, 343, 344; 362/415, 431, 806; D26/8; 102/343; 270/375

[56] References Cited

U.S. PATENT DOCUMENTS

| | | | |
|---|---|---|---|
| 82,579 | 9/1868 | Atterbury et al. | 362/415 |
| 252,284 | 1/1882 | Williams | 431/146 |
| 1,581,818 | 4/1926 | Sheffield et al. | 270/375 |
| 2,121,904 | 6/1938 | Currie | 431/324 |

FOREIGN PATENT DOCUMENTS

| | | | |
|---|---|---|---|
| 175086 | 11/1952 | Austria | 431/146 |
| 142466 | 3/1979 | German Democratic Rep. | 431/320 |

OTHER PUBLICATIONS

Carton and Instructions for "Tropic Torches", Mfr'd. by Patio Products, Inc., Newark, N.J.

*Primary Examiner*—Carroll B. Dority, Jr.

*Attorney, Agent, or Firm*—Kirschstein, Kirschstein, Ottinger & Israel

[57] ABSTRACT

A liquid fuel burning torch includes a container having a substantially barrel-shaped main portion which defines a chamber accommodating a liquid fuel during use. The top wall of the container has an upwardly upset threaded neck portion on which there is mounted a closing cap having a circumferential wall provided with external and internal threads, the internal threads meshing with the external threads of the neck portion. The closing member also has a transverse wall which has a central aperture for the passage of a wick therethrough. A snuffer cap having a circumferential wall provided with threads meshing with the external threads of the closing member can be fittingly mounted on the closing member so as to extinguish the flame by denying access of oxygen to the wick portion extending outwardly of the closing member. The closing member has an external flange which frictionally engages the top wall of the container around the neck portion upon tightening. The threads and the flange virtually prevent the fuel from escaping from the interior of the container. The snuffer cap is mounted on a mounting portion extending downwardly from the bottom wall of the container by a chain. The mounting portion has an external circumferential groove, and the chain carries a bifurcated securing element which has two resilient arms that partially embrace the mounting portion and are partially accommodated in the groove.

4 Claims, 4 Drawing Figures

LIQUID FUEL BURNING TORCH

BACKGROUND OF THE INVENTION

The present invention relates to liquid fuel burning torches in general, and more particularly to torches of this type which are especially suited for use in illuminating patios and similar outdoor locations.

Torches of this type are already on the market and are known, for instance, as so-called tropic luau torches. In one conventional construction of such a torch, there is provided a substantially barrel-shaped container which has a chamber for accommodating a quantity of the liquid fuel and includes a socket-shaped mounting portion extending downwardly from the bottom wall of the container, and a filling neck provided on the top wall of the container and bounding a filling opening. Then, a substantially cup-shaped closing member is removably mounted on the filling neck and has a central aperture through which a wick extends from the interior to the exterior of the container. When the closing member is removed from the filling neck, an original or a replacement wick can be introduced into the central aperture of the closing member, so that the latter can subsequently act as a wick-supporting member. Furthermore, the liquid fuel can be poured into the internal chamber of the container through the filling neck. Then, the closing member is slid over the filling neck while the wick is simultaneously introduced through the opening of the filling neck into the interior of the container. Once this procedure is accomplished and the length of the wick sticking out of the aperture of the closing member is adjusted as desired, the torch is ready to be lit.

This conventional luau torch also includes a snuffer cap which is primarily used for extinguishing the flame when the operation of the torch is to be discontinued. This snuffer cap is so dimensioned that it can be easily slid over the covering member and will then substantially prevent access of atmospheric oxygen to the flame or to the portion of the wick which extends upwardly of the closing member. Thus, the flame is extinguished, and excessive evaporation of the liquid fuel from the wick is avoided so long as the snuffer cap is present on and around the closing member.

In order to avoid misplacement of the snuffer cap and to keep the latter handy for use whenever desired, it is connected to the container by a flexible elongated member, especially a chain. In the aforementioned conventional construction, the chain is connected to the snuffer cap at one of its ends, and to the closing member at its other end. The closing member has an outwardly extending flange which is juxtaposed with the top wall of the container when the closing member is mounted on the filling neck, and the other end of the chain is connected to this flange. This has the disadvantage that the seating of the closing member on the top wall of the container is less than perfect, so that an amount of vapors of the liquid fuel can escape between the flange and the top wall of the container into the environment, Moreover, the closing cap of the conventional torch is held in position on the filling neck by an inward bulge of the circumferential wall thereof which frictionally engages the filling neck. Thus, an interface through which an additional amount of the evaporated fuel can escape is created between the external surface of the filling neck and the internal surface of the circumferential wall of the closing member. Finally, the snuffer cap of the conventional torch is merely slid over the closing member, so that still more of the evaporated fuel can escape through the interface between the snuffer cap and the closing member when the snuffer cap is mounted on the container.

SUMMARY OF THE INVENTION

Accordingly, it is a general object of the present invention to avoid the disadvantages of the prior art.

More particularly, it is an object of the invention to provide a torch, especially for outdoor use, which does not possess the disadvantages of the conventional torches of this type.

Still another object of the present invention to so construct the torch of the type here under consideration as to minimize the amount of evaporated fuel escaping from the interior of the torch into the environment both during the periods of use and the periods of non-use of the torch.

It is yet another object of the present invention to devise a torch of the above type in which even spillage of the liquid fuel or its leakage in other than the operating position of the torch is reduced if not eliminated altogether.

A concomitant object of the invention is so to design the torch of this type as to be simple in construction, inexpensive to manufacture, easy to use, and reliable in operation nevertheless.

In pursuance of these objects and others which will become apparent hereafter, one feature of the present invention resides in a torch arrangement for use in conjunction with a wick for burning liquid fuel, this torch arrangement comprising a container centered on an axis which extends substantially vertically in an operating position of the arrangement, and including a main portion bounding a chamber for the liquid fuel and having a top and a bottom wall as considered in the operating position, the top wall having a central opening, the container further including at least one mounting portion extending downwardly from and rigid with the bottom wall of the main portion of the container, and a wick-supporting portion so mounted on the top wall of the main portion as to surround the central opening of the top wall and having a central aperture of a diameter smaller than that of the central opening in the top wall for the passage of the wick therethrough from the chamber of the main portion to the exterior of the container; a snuffer cap separate from the container and so dimensioned as to fit over and around the wick-supporting portion; and flexible connecting means for connecting the snuffer cap to the mounting portion of the container. A particular advantage of this construction is that, since the flexible connecting means is connected to the mounting portion rather than to the wick-supporting portion, the latter can be so designed as to obtain excellent vapor and possibly also liquid tight seat between the wick-supporting portion and the top wall of the container.

Advantageously, the top wall includes a tubular upwardly upset neck portion surrounding the opening of the top wall, the wick-supporting portion being then constructed as a substantially cup-shaped closing member separate from the main portion of the container and removably mounted on the tubular portion of the top wall. It is further advantageous when the tubular portion of the top wall of the container has a thread-shaped external formation thereon, especially an embossed one, and when the closing member has a compatibly configurated, preferably also embossed, internal thread-shaped formation thereon, this formation meshing with the external formation of the tubular neck portion during and upon assembly of the closing member with the main portion of the container. In this construction, it is especially advantageous when the cup-shaped closing member has a rim and a flange extending outwardly from the rim and frictionally engaging the top wall of the main portion of the container around the tubular neck portion in a fully assembled position of the closing member with respect to the main portion of the container. The flange then not only renders the seating of the closing member on the top wall of the main portion of the container virtually impervious to gaseous and liquid media, but also increases the resistance of the closing member to unscrewing during the initial phase, an expedient whose utility will become apparent presently. Of course, the threaded formations themselves form a labyrinthine path, thus rendering escape of vapors or liquid less likely than in the conventional construction.

According to a further advantageous facet of the present invention, the closing member has an external thread-shaped connecting portion and the snuffer cap has a compatibly configurated internal thread-shaped portion engaging the external thread-shaped connecting portion during and upon assembly of the snuffer cap with the closing member. Advantageously, the internal formation and the external connecting portion of the closing member are aligned with and substantially complementary to one another. This result can advantageously be obtained by embossing the threads. It will be appreciated that, because of the additional resistance to unscrewing presented by the flange of the closing member, the snuffer cap will become preferentially unscrewed from the closing member when an appropriate torque is applied thereto. It will also be seen that the labyrinthine path constituted by the internal and external threads of the snuffer cap and of the closing member, respectively, will considerably hamper if not eliminate the escape of gaseous or liquid media between the snuffer cap and the closing member.

It is further advantageous when the snuffer cap has an external projection, such as a lug, which extends along a course deviating from the closing member and the top wall of the main portion of the container even when the snuffer cap is fitted over and around the closing member, and when the flexible connecting means includes an elongated flexible element attached to the external projection or lug of the snuffer cap. In this context, it is advantageous when the external projection or lug of the snuffer cap has a free portion having an orifice, and when the flexible element extends through this orifice. This is particularly advantageous when the flexible element is a chain, in that an end link of the chain can then extend through the aforementioned orifice.

According to an additional advantageous aspect of the present invention, the mounting portion of the container has an external groove, and the flexible connecting means includes an elongated flexible element, such as the aforementioned chain, this flexible element having one end portion connected to the snuffer cap and another end portion, and a bifurcated securing element connected to the other end portion of the flexible element, partially embracing the mounting portion, and partially received in the groove of the latter. In this respect, it is especially advantageous when the mounting portion is substantially cylindrical, and when the bifurcated securing element includes two resilient arms extending along respective part-circular courses each to partially embrace, and to be partially received in the groove of, the mounting portion at one side of the latter upon assembly, and to resiliently yield during assembly and disassembly.

In accordance with a particularly advantageous expedient contemplated by the present invention, the mounting portion includes an inner part integral with the main portion of the container, and an outer part surrounding the inner part and extending downwardly beyond the same to form a pole-receiving recess therewith. Then, it is advantageous when the inner part of the mounting portion has a circumferentially extending recess, and when the outer part has a detaining formation therein which forms the aforementioned groove at the exterior of the outer part and a bulge in the interior of the outer part, the bulge being fittingly received in the recess of the inner part to thus secure the outer part to the inner part.

The novel features which are considered as characteristic of the invention are set forth in particular in the appended claims. The improved torch arrangement itself, however, both as to its construction and its mode of operation, together with additional features and advantages thereof, will be best understood upon perusal of the following detailed description of a certain specific embodiment with reference to the accompanying drawing.

DETAILED DESCRIPTION OF THE PREFERRED EMBODIMENT

Figures 1, 2, 3, 4:
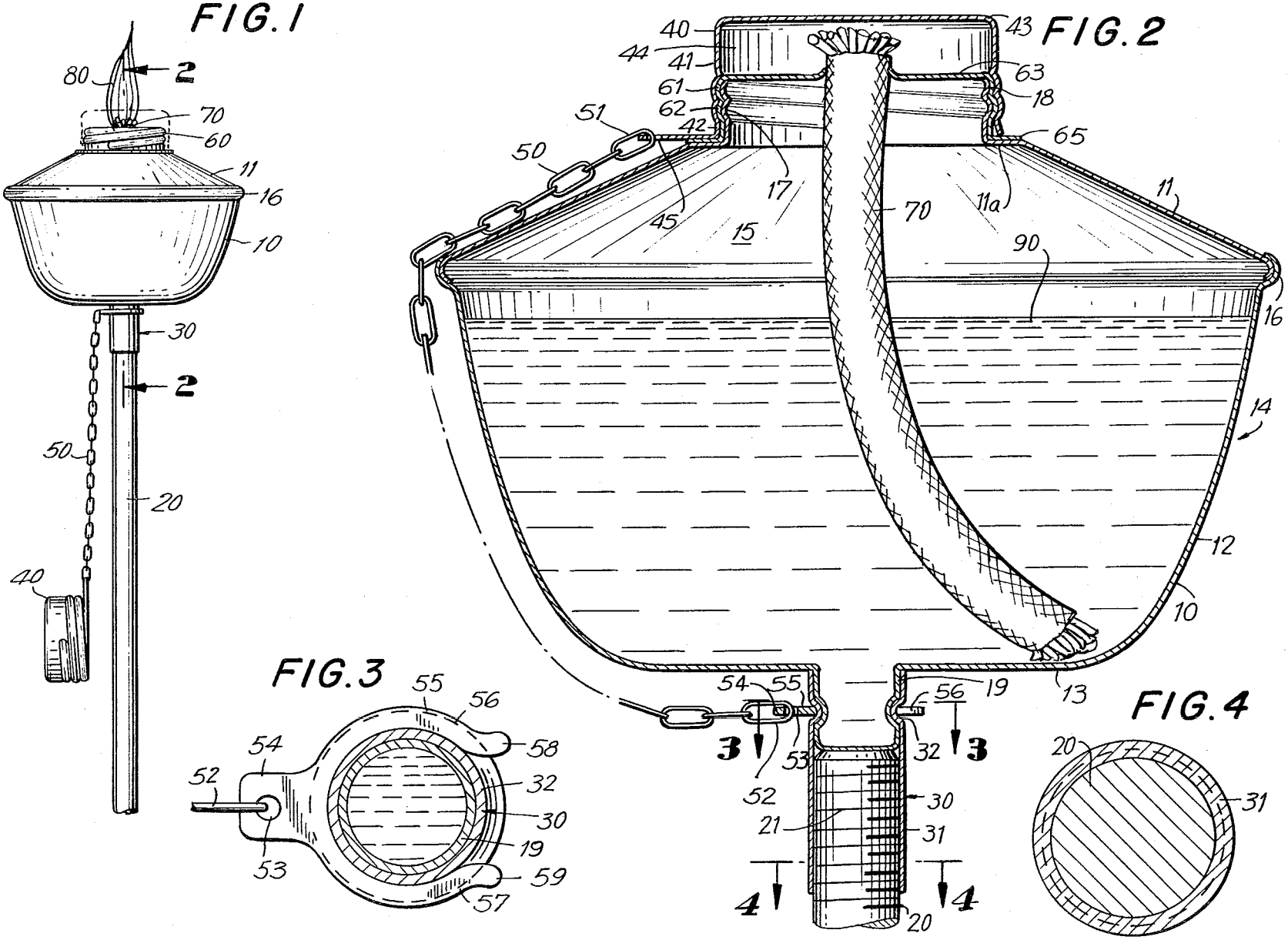
FIG. 1 is a side elevational view of the torch arrangement of the present invention in its operating position on top of a support pole and as used for burning liquid fuel.
FIG. 2 is an axial sectional view of the torch arrangement of FIG. 1 as mounted on the support pole, and at a scale enlarged relative to that of FIG. 1.
FIG. 3 is a cross-sectional view taken on line 3—3 of FIG. 2 at a further enlarged scale.
FIG. 4 is a cross-sectional view taken on line 4—4 of FIG. 2 at a scale corresponding to that of FIG. 3.

Referring now to the drawing in detail, and first to FIG. 1 thereof, it may be seen that the reference numeral 10 has been used to identify a liquid fuel container. The container 10 is shown to be supported in its operating position on top of a support pole 20, by means of a mounting portion 30. A snuffer cap 40 is also mounted on the mounting portion 30, by means of a connecting chain 50. A closing member 60 is mounted on a top wall 11 of the container 10 and supports a wick 70 that partially extends upwardly of the closing member 60, so that liquid fuel rising through the same due to capillary action evaporates at the exterior of the container 10 and the vapors may be lit to form a flame 80.

As shown particularly in FIG. 2, the container 10 has the top wall 11 which merges into and is rigidly connected to a circumferential wall 12 which, in turn, merges into a bottom wall 13. The walls 11, 12 and 13 together constitute a main portion 14 of the container 10, the main portion 14 bounding an enclosed chamber 15 which is shown to contain a body 90 of a liquid fuel. The main portion is shown to be constructed of two parts which are rigidly and sealingly connected to one another at a junction region 16. One of these parts is constituted by the top wall 11, while the other part includes the circumferential wall 12 and the bottom wall 13.

The top wall 11 is integrally formed with an upwardly upset tubular neck portion 17 which is provided, especially embossed, with a threaded formation 18 that forms an external thread. The bottom wall 13 is integrally formed with a downwardly extending hollow inner part 19 partially constituting the mounting portion 30.

The mounting portion 30 further includes a tubular outer part 31 which surrounds the inner part 19 and extends downwardly beyond the latter to form a socket for receiving an upper end portion 21 of the supporting pole 20. The upper end portion 21 is shown to be threaded or otherwise corrugated to obtain firm fit in the socket constituted by the parts 19 and 31 of the mounting portion 30. The parts 31 and 19 are inwardly pinched and thus secured against axial displacement relative to one another. The pinched region of the outer part 31 forms an external groove 32.

The closing member or wick-supporting portion 60 includes a substantially cylindrical circumferential wall 61 which is formed with a threaded formation 62 which forms both an internal and an external thread. The circumferential wall 61 merges into a transverse wall 63 that has an upwardly upset zone 63 that bounds an aperture through which the wick 70 passes and in which it is retained. It will be appreciated that the upwardly upset zone 63, due to its resilient properties, will offer a greater resistance to the movement of the wick 70 in the downward direction than to the extraction of the wick 70 in the upward direction, so that the wick 70 will be securely retained against dropping back into the body of liquid fuel 90.

The closing member 60 further includes an outwardly extending flange 65 which, in the illustrated closing position or fully assembled position of the closing member 60, frictionally engages a substantially planar portion 11*a* of the top wall 11 of the container 10. The substantially cup-shaped closing member 60 is screwed onto the tubular portion 17, so that the thread-forming formations 18 and 62 mesh with one another. A certain amount of tightening torque applied after the flange 65 has first contacted the planar portion 11*a* of the top wall 11 will result in the above-mentioned frictional contact of the flange 65 with the planar portion 11*a*, so that a commensurate amount of releasing torque will have to be initially applied for unscrewing the closing member 60.

The snuffer cap 40 is configurated similarly to but dimensioned differently from the closing member 60. Like the closing member 60, the snuffer cap 40 has a circumferential wall 41 of a substantially cylindrical shape provided with a threaded formation 42 which forms at least an internal thread which meshes with the external thread of the closing member 60 to mount the snuffer cap 40 on the closing member 60. The snuffer cap 40 also has a transverse wall 43 which, however, is imperforate, so that it delimits an enclosed space 44 between itself, the circumferential wall 41, and the transverse wall 63 of the closing member 60. The enclosed space 44 accommodates that portion of the wick 70 that projects upwardly beyond the transverse wall 63 of the closing member 60 and prevents access of additional atmospheric oxygen to this wick portion once the snuffer cap 40 is tightly threaded onto the closing member 60, so as to extinguish the flame 80.

The snuffer cap 40 also has an outwardly extending projection or lug 45 which deviates from the flange 65 of the closing member 60 and from the top wall 11 of the container 10. The projection or lug 45 has an orifice through which a last link 51 of the chain 50 extends to connect the chain 50 to the lug 45 and thus to the snuffer cap 40. Another end link 52 of the chain 50 extends through an orifice 53 provided in a lug 54 of a bifurcated connecting element 55 which may best be seen in FIG. 3. The bifurcated connecting element 55 has two arms 56 and 57 which are resilient to yield during assembly and disassembly. As also shown in FIG. 3, the arms 56 and 57 of the connecting element 55 are partially received in the groove 32 and embrace the mounting portion 30 from the opposite sides. The arms 56 and 57 have respective outwardly bent free end portions 58 and 59 which facilitate the assembly of the connecting element 55 with the mounting portion 30 in that they cause the arms 56 and 57 resiliently yield in the outward direction during the assembling operation.

It will be appreciated that, due to the provision of the tightly meshing threaded formations 17, 62 and 42, and of the flange 65 which tightly engages the flat portion 11*a* of the top wall, there is obtained a highly reliable sealing effect at the respective interfaces, so that escape of the fuel in its vaporous or liquid form from the chamber 15 to the exterior of the container 10 is virtually non-existent, especially when the respective components are properly tightened and the snuffer cap 40 is mounted on the closing member 60. Since the chain 50 connecting the snuffer cap 40 is connected to the mounting portion 30 rather than to the closing member 60, the sealing action of the flange 65 of the latter is undisturbed. The flange 65 will also act, due to its frictional engagement with the top wall 11, to retain the closing member 60 in position while the snuffer cap 40 is being unscrewed. Moreover, since the chain 50 is mounted on the mounting portion 30, the snuffer cap 40 will be suspended to be located next to the supporting pole 20 rather than next to the metallic container 10. Thus, the pole may be made of a noise-damping material, such as wood or synthetic plastic material, so that impingement of the snuffer cap 40 under the influence of wind will not result in annoying chiming or rattling noises.

It will be understood that each of the elements described above, or two or more together, may also find a useful application in other types of arrangements differing from the type described above.

While the invention has been illustrated and described as embodied in a luau torch arrangement for use on patios or similar outdoor locations for illumination or atmosphere purposes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

I claim:

1. A pole-mounted, fuel-spill-resistant, outdoor torch arrangement for use in conjunction with a wick for burning liquid fuel, comprising:

a container centered on a pole defining an axis extending substantially vertically in an operating position of the arrangement, said container including a main reservoir portion bounding a chamber for the liquid fuel and having a top and a bottom wall as considered in the operating position, said top wall having a tubular upwardly upset portion surrounding a central opening, said tubular portion of said top wall having a thread-shaped external formation thereon, and at least one mounting portion rigid with and extending downwardly from said bottom wall of said main portion, said mounting portion having an inner part integral with said main portion and an outer part surrounding said inner part and extending downwardly beyond the same to form a lower pole-receiving recess below said bottom wall as considered in the operating position;

a substantially cup-shaped closing member separate from said container and removably mounted on said tubular portion of said top wall, said closing member having a wick-supporting portion having a central aperture of a diameter smaller than that of said central opening for the passage of the wick therethrough between said chamber and the exterior of said container, said closing member having a rim and a flange extending outwardly from said rim and frictionally engaging said top wall of said main portion around said tubular portion, said closing member having a compatibly configurated thread-shaped internal formation thereon which meshes in fuel-sealing relationship with said external formation of said tubular portion of said top wall in a fully assembled position of said closing member with respect to said container, said closing member also having an external thread-shaped connecting portion thereon;

a snuffer cap separate from said container and removably mounted on said closing member, said snuffer cap having a sealing portion which sealingly engages over and around said wick-supporting portion upon assembly thereon, said snuffer cap having a compatibly configurated internal thread-shaped connecting portion which engages said external connecting portion during and upon assembly with said closing member, said snuffer cap having an external projection having a free end portion remote from said sealing portion; and flexible means for connecting said snuffer cap to said mounting portion of said container, said flexible means including an elongated flexible element having one end region connected to said snuffer cap at said remote free end portion, and an opposite end region connected to said mounting portion in the vicinity of said lower pole-receiving recess below said bottom wall, said flexible element extending along a course which lies between said top and bottom walls of said container upon assembly of said snuffer cap with said closing member, said flexible element being suspended vertically downwardly from said mounting portion to be located next to the pole along the entire length of the element upon disassembly of said snuffer cap with said closing member.

2. The torch arrangement as defined in claim 1, wherein said mounting portion has an external groove; and wherein said flexible connecting means includes an elongated flexible element having one end portion attached to said snuffer cap and another end portion, and a bifurcated securing element connected to said other end portion of said flexible element, partially embracing said mounting portion, and partially received in said groove of the latter.

3. The torch arrangement as defined in claim 2, wherein said mounting portion is substantially cylindrical; and wherein said bifurcated securing element includes two resilient arms each extending along a part-circular course to partially embrace, and to be partially received in said groove of, said mounting portion at one side of the latter upon assembly, and to resiliently yield during assembly and disassembly.

4. The torch arrangement as defined in claim 1, wherein said inner part has a circumferentially extending recess; and wherein said outer part has a detaining formation therein which forms said groove at the exterior of said outer part and a bulge at the interior of said outer part which is fittingly received in said recess of said inner part and thus secures said outer part to said inner part.

* * * * *